United States Patent [19]

Osrow et al.

[11] 3,997,759

[45] Dec. 14, 1976

[54] PORTABLE HAND-MANIPULATABLE STEAMER FOR LOOSENING THE BOND BETWEEN WALLPAPER AND A SUBSTRATE

[75] Inventors: Leonard Osrow, Great Neck; Jacques L. LeBaigue, Greenlawn, both of N.Y.

[73] Assignee: Osrow Products Co., Inc., Glen Cove, N.Y.

[22] Filed: Nov. 18, 1974

[21] Appl. No.: 524,716

[52] U.S. Cl. ..... 219/272; 38/69; 68/222; 126/271.1; 200/50 A; 219/275; 219/288; 219/295

[51] Int. Cl.[2] ..... H05B 3/60; F22B 1/30; A47L 13/00

[58] Field of Search ..... 219/271–276, 219/284–295; 126/271.1; 239/136; 68/222; 38/69, 77.2, 77.82; 200/50 A, 61.58, 61.62

[56] References Cited

UNITED STATES PATENTS

| | | | |
|---|---|---|---|
| 1,391,350 | 9/1921 | Tucker | 126/271.1 X |
| 1,518,454 | 12/1924 | Riche | 126/271.1 |
| 1,717,040 | 6/1929 | Kaufman et al. | 219/272 |
| 2,137,876 | 11/1938 | Hudson | 219/271 X |
| 2,152,122 | 3/1939 | Wilcox | 219/288 X |
| 2,172,917 | 9/1939 | Voight | 68/222 |
| 2,676,239 | 4/1954 | Sanzone et al. | 126/271.1 |
| 2,861,365 | 11/1958 | Block | 38/77.82 |
| 3,690,024 | 9/1972 | Osrow | 68/222 |
| 3,695,066 | 10/1972 | Doyel | 68/222 |
| 3,755,649 | 8/1973 | Osrow | 219/288 X |

FOREIGN PATENTS OR APPLICATIONS

| | | | |
|---|---|---|---|
| 817,776 | 10/1951 | Germany | 219/288 |
| 886,713 | 1/1962 | United Kingdom | 126/271.1 |

*Primary Examiner*—A. Bartis
*Attorney, Agent, or Firm*—Kirschstein, Kirschstein, Ottinger & Frank

[57] ABSTRACT

A device for applying steam to the exposed surface of previously applied wallpaper so as to cause the same to penetrate the wallpaper and loosen the adhesive bond between the wallpaper and the underlying substrate. The device is a compact steamer for vertical surfaces which is composed of a forward steam plenum chamber and a rear water chamber having a common separating wall between them. The steam plenum chamber has a steam discharge opening in its front wall. Associated with the common wall is a steam passageway that is wholly contained within the steamer. The steam passageway leads from a steam entry port near the top of the water chamber to a steam discharge port in the steam plenum chamber. To heat the water in the water chamber to steaming temperature, a pair of mutually spaced electrodes is disposed in and near the bottom of the water chamber and is supplied with power through a manually operable switch. A cap selectively closes a fill-opening in the water chamber. The cap and switch are provided with an interlock which prevents opening of the fill-cap when the switch energizes the electrodes and which prevents the switch from being moved to actuated position unless the fill-cap is closed.

14 Claims, 4 Drawing Figures

PORTABLE HAND-MANIPULATABLE STEAMER FOR LOOSENING THE BOND BETWEEN WALLPAPER AND A SUBSTRATE

BACKGROUND OF THE INVENTION

1. Field of the Invention

A hand-manipulatable light-weight steamer in which steam is generated by electrolyte heating and applied to wallpaper to loosen the adhesive bond between the wallpaper and the substrate.

2. Description of the Prior Art

Wallpaper is, to a very substantial extent, held to an underlying substrate by the interposition of a layer of adhesive which is applied as a paste and subsequently dries to perfect an adhesive bond. With the passage of time, it becomes desirable to remove such wallpaper, either because it has faded or has been abused or because it is desired to change the decor of a room. Most wallpaper is pervious to steam and most adhesives employed are water-soluble. Accordingly, with such wallpapers and such adhesives it has been the practice to weaken or destroy the adhesive bond by causing steam to penetrate the wallpaper and condense in back of the wallpaper between the wallpaper and the substrate so as to form water which wets the dried adhesive and greatly reduces its holding capacity to the extent that the wallpaper then can be peeled or scraped from the substrate without materially affecting the integrity of the substrate. The heat of the steam aids in loosening the bond. The foregoing enables fresh wallpaper or paint to be applied to the substrate without any substantial degree of preparation. It is noted, in passing, that there are wallpapers that are impervious to steam. Frequently, these can be stripped off to expose an underlying paper support which then can be steamed off.

Usually, the steaming of previously applied wallpaper is effected by a professional paperhanger. However, for some time, due to the desire of homemakers to turn their hands to advantage and, furthermore, due to the steadily increasing price of skilled labor, and to the increasing amount of leisure time with the shortening of working hours, home owners and apartment dwellers have increasingly turned to the stripping of applied wallpaper, sometimes with the subsequent application of new wallpaper and sometimes just to save money in connection with the removal of old wallpaper with the intent that a professional paperhanger will be permitted to hang fresh wallpaper.

When a professional paperhanger was requested to remove wallpaper, he frequently employed special equipment for this purpose, disdaining the slower process of simply applying water to the existing wallpaper and waiting for it to soak through to the underlying adhesive, because this was a time-consuming and untidy procedure. Equipment most commonly used for the aforesaid purpose was a somewhat heavy vessel designed to rest on the floor and having a heater associated with it. The vessel contained water, the heater brought the water to a boil, the steam generated in the vessel was led by a flexible supply circuit to a hand-held plenum chamber from which condensed water was led back to the vessel by a flexible return conduit. A conduit was not always employed. The plenum chamber included a handle to enable an operator to move the chamber over applied wallpaper on a wall of a room. The heater employed sometimes used gas and sometimes used liquid fuel. More modern steamers employed electric heaters of the resistance type. This type of wallpaper steamer was uniquely adapted for utilizaiton by a professional paperhanger because it contained a considerable amount of water and did not require frequent refilling. However, it did not find favor with home owners and apartment dwellers because it was too bulky and heavy and far too costly for the occasional use to which it was put by such persons. Moreover, this type of wallpaper steamer transmitted live steam from the steam generating vessel to the plenum chamber and, should a break develop in the conduit employed for transmission of the steam, a potentially dangerous situation could be created.

It has been proposed to improve the aforesaid professional wallpaper steamers by eliminating the large heating vessel and supplanting the same with a water supply conduit from a locally available tap which conduit ran to a heating chamber adjacent the plenum chamber. This, too, although useful for day-to-day operation, was cumbersome to employ due to the presence of the flexible water conduit. It also was costly and bulky and, hence, was not a pactical device for occasional use.

It also has been proposed to construct a wallpaper-removing steam-applying device having its own water chamber and plenum chamber and having an electric resistance heater associated with the water chamber. Such devices have been suggested only where the heating device utilized an electric resistance heater which necessarily was external to the water heating chamber. These devices had serious drawbacks which have prevented the successful manufacture of a portable hand-manipulatable steamer for loosening the bond between wallpaper and a substrate. The principal defects arose from the use of a heater of the type mentioned. It was comparatively bulky, thereby increasing the size of the steamer. It was susceptible to breakdown because electric resistance heaters are notoriously subject to the drawback that the heating coils become fragile and are prone to break. Because the coil was external to the heating chamber, the heat was not employed efficiently and, moreover, the heat was conducted in various directions so that the entire steamer could become too hot or too uncomfortably warm to hold. Additionally, if the resistance heater were located inside the water chamber, the structure became expensive to make and the heating element became difficult to remove in the case of breakage.

Furthermore, hand-manipulatable portable steamers of the type mentioned continued to operate so long as the electric switch to the heating element was closed, so that it was possible to burn out the element or to overheat and destroy the steamer. In addition, if a steamer of the type just described were placed down on a horizontal surface and the operator forgot to turn off the switch to the heating element, the heating element easily could burn out because the conduction of heat between the heating element and the water in the chamber might be less effective due to a shift in the location of the water in such chamber. Hence, such steamers were susceptible to destruction and to damage of surrounding objects or to the operator.

SUMMARY OF THE INVENTION

1. Purposes of the Invention

It is an object of the present invention to provide a portable hand-manipulatable steamer for loosening the bond between wallpaper and a substrate which is not subject to any of the foregoing drawbacks and which, nevertheless, is simple to make, easy to use and constitutes relatively few and inexpensive parts.

It is another object of the present invention to provide a steamer of the character described which is light-weight and comparatively small in size and which is particularly easy to manipulate against a vertical surface.

It is another object of the present invention to provide a steamer of the character described which automatically will shut itself off if the water level in the water chamber drops too low.

It is another object of the present invention to provide a steamer of the character described which automatically will cut off when placed on a horizontal surface.

It is another object of the present invention to provide a steamer of the character described which is particularly efficient in its use of electricity for heating purposes.

It is another object of the present invention to provide a steamer of the character described which is reliable in operation.

It is another object of the present invention to provide a steamer of the character described which includes a foolproof arrangement for preventing the heating element from being energized when a fill-cap for the water chamber is removed and which will pevent removal of the fill-cap so long as the heating element is energized.

Other objects of the invention in part will be obvious and in part will be pointed out hereinafter.

2. Brief Description of the Invention

The steaming device of the present invention is a light-weight, small, compact wallpaper steamer which includes a plenum chamber the side walls of which define an open front face designed to glide over a vertical surface covered with old wallpaper The rear wall of the plenum chamber has mounted on it a water reservoir preferably having a major dimension that is vertically oriented when the steamer is held against a vertical surface. A passageway leads from the water chamber to the plenum chamber. The passageway has a steam inlet adjacent the top of the water chamber and a steam outlet adjacent the bottom of the plenum chamber. The steam inlet extends toward the rear of the water chamber and is of small transverse area. The steam outlet, on the other hand, is of substantial transverse area so as to encourage diffusion of steam to a substantial extent and thereby enable the uniform application of steam to a papered surface. The steam passageway graduallly enlarges in transverse area from the inlet to the outlet whereby to encourage the uniform dispersion of water particles and thus the uniform application to the maximum extent possible of steam and water particles within the plenum chamber. Due to the placement of the steam inlet near the top of the water chanmber and close to the rear wall thereof, the flow of water in bulk through this inlet is discouraged, whether the steamer be upright in its use position or resting flat on a horizontal surface. In both cases, the steam inlet will be above the surface of the water in the water chamber.

To heat the water in the water chamber a pair of electrodes is disposed near the bottom of the water chamber. Heat is generated by supplying electric energy to the electrodes. AC energy preferably is used inasmuch as the heat is generated by passage of electric current through the water, hence, the use of the term 'electrolytic' for this type of heater. Obviously, electrolytic action is not particularly desired nor is it unwanted. Electrlytic action simply dissociates the water molecules into their constituent elements but the amount of water thus consumed is negligible in comparison with the bulk of water that is transformed into steam by the electrolytic heater. This electrolytic generation of heat can be encouraged by the addition of a water-soluble salt to the water in the water chamber such, for example, as common table salt, the amount of heat thus generated being quite substantial when sufficient salt is added. Indeed, the rate of boiling of the water and, hence, liberation of steam, can be increased by the user simply by adding increments of table salt.

At any accessible part of the water chamber, for example, the rear wall thereof, a fill-opening is provided, the same having for cooperation therewith a fill-cap which is removed when water or salt is to be added and is to be closed when the steamer is in operation. Because the heating device is electrolytic and because the water in the water chamber is electrically conductive to a greater or lsseer degree, depending upon the impurities in the water or the amount of salt deliberately added, it is highly desirable that this water be electrically isolated from a user when the electrodes are energized.

Accordingly, there is provided an on/off switch in the circuit for supplying electricity from an external source to the electrodes, and this on/off switch is associated with an interlock the position of which is controlled by the fill-cap. The interlock is so constructed that it will prevent turning and, therefore, removal of the fill-cap unless the electric switch is in off position, and it will prevent the electric switch from being turned to on position unless the fill-cap is emplaced over the fill-opening and turned to a cap-locked position. A handle is included, preferably being mounted on the rear wall of the water chamber. The operator for the electric switch is likewise mounted on this wall in a position convenient to be manipulated by a finger on a hand of the user which is gripping the handle.

The electrodes are elongated elements which in a preferred frm of the invention extend from side to side of the water chamber, are in substantially the same horizontal plane when the steamer is in its vertical operating position, and are spaced from one another in a front-to-back direction, i.e. in a direction perpendicular to a vertical wall surface. This relative spacing of the electrodes will cause the electrode that is more remote from a vertical surface to emerge from the body of water in the water chamber when the steamer is placed on a horizontal surface so as to obtain the automatic cut-off previously referred to when the steamer is so handled. Moreover, the electrodes are spaced somewhat above the bottom wall of the water chamber and, in this manner, both rise above the surface of water in the water chamber when the water reaches a low level, hence, automatically cutting off the heater when the water supply drops too low.

In one form of the invention the free edges of the walls peripherally defining the open mouth of the plenum chamber have mounted thereon a flexible skirt made, for example, of a natural or synthetic elastomer or even of a thin-walled flexible plastic, the purpose thereof being to permit the distal edges of the skirt to glide over a vertical surface being steamed.

The invention accordingly consists in the features of construction, combination of elements and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention.

DESCRIPTION OF THE PREFERRED EMBODIMENT

Figure 1:
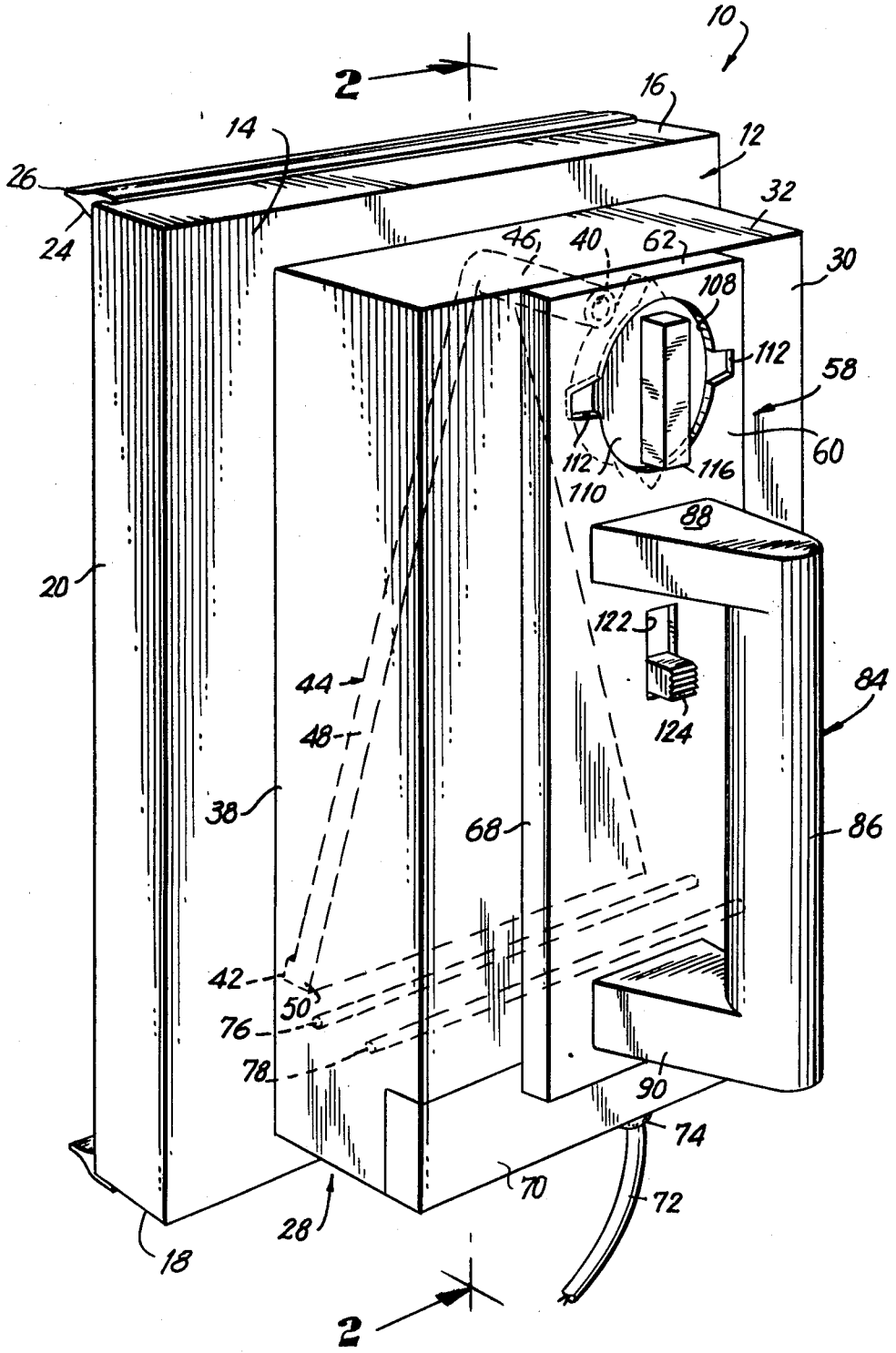
FIG. 1 is a three-quarter rear view of the wallpaper steamer according to the present invention.

Referring now in detail to the drawings, the reference numeral 10 denotes a portable hand-manipulatable steamer for loosening the bond between wallpaper and a substrate. All of the external parts of the steamer are made from a synthetic plastic, preferably by injection molding, and since almost all of the components of the steamer are at least partially visible on the exterior, the entire steamer is very light in weight and, hence, can be manipulated by a home owner or apartment dweller for extended periods of time over large areas without the user's hand, arm, shoulder or back becoming unduly tired. Moreover, due to such light weight, the steamer is extremely easy to move about, so that the utilization of the same is not a chore. Also due to its light weight, the steamer is quite easy to employ on elevated parts of a vertical wall without tiring the user.

In addition, the internal non-visible components such, for example, as the switch and the electrodes, are of negligible weight so that they do not detract from the foregoing advantages.

The water chamber in the steamer 10 is of rather small volume so that the weight of the water therein likewise does not substantially affect the ease of use of the steamer, although there is sufficient water to render unnecessary refilling of the chamber every few minutes. The water contained in the water chamber suffices to run the steamer for 30 to 40 minutes (depending upon the amount of salt in the water) which is enough for home and apartment use.

The steamer 10 includes a plenum chamber 12 which constitutes a rear plenum wall 14, a top plenum wall 16, a bottom plenum wall 18 and side plenum walls 20, 22. Conjointly these define a shallow space best seen in FIG. 2 which, in the preferred form of the invention illustrated, is of vertically elongated rectangular shape.

For the purpose of reference, all directions will be based upon the steamer shown in the position of FIG. 1 which is as it appears when pressed against a vertical surface with the top plenum wall 16 uppermost and with the bottom plenum wall 18 in vertical registration with and beneath the top plenum wall.

The front face of the plenum chamber is open providing a mouth of maximum size for egress of steam which will be detailed hereinafter. Optionally, the rim of the mouth may be provided with a skirt 24 which is formed of a pliable material including a channel-shaped section that frictionally grips the rim of the mouth and a thin resilient flange 26 forming an extension of the mouth of said plenum chamber. The skirt enables the steamer 10 to be pressed against the wall lightly without inhibiting movement of the steamer about the wall. In addition, the resilient flange 26 permits the steamer to accommodate its open mouth to irregular configurations on the surface of the wall and, hence, effects a better seal between the moving steamer and the wallpaper which is to have steam passed therethrough for the purpose of loosening the adhesive bond.

The plenum chamber, as indicated previously, is made from a synthetic plastic so that it is inexpensive to manufacture and is light in weight. Desirably, all parts of the plenum chamber are molded as a single piece. Immediately to the rear of the plenum chamber is a water chamber 28. Said chamber includes a rear wall 30, a top wall 32, a bottom wall 34, and side walls 36, 38. The front of the water chamber constitutes a portion of the rear plenum wall 14. As illustrated, the water chamber is molded of a synthetic plastic and the front edges of the top, bottom and side walls of the water chamber are secured to said rear plenum wall 14 in any suitable fashion such, for example, as by adhesice bonding or heat and pressure welding, so that, in effect, the water chamber and the plenum chamber become unitary.

A passageway is included to provide for fluid communication between the water chamber 28 and the plenum chamber 12. Certain aspects of the passageway are particularly desirable for the most efficient practicing of the invention. These aspects constitute the inclusion in said passageway of a steam entry port 40 and a steam discharge port 42 in certain locations. More specifically, the steam entry port 40 is located near the top of the water chamber and near the rear wall 30 of the water chamber as can be clearly seen in FIGS. 1 and 2, and the steam discharge port is located near the bottom of the plenum chamber. Desirably, the steam entry port is of small cross-sectional area, and the steam discharge port has a dimension which is elongated transversely of the plenum chamber, i.e. extends from side to side thereof. The aforesiad steam passageway is denoted by the reference numeral 44 and is in the form of a stub tube 46 which is horizontal and extends forwardly from the steam entry port to adjacent the rear plenum wall 14, the tube being located on the vertical center line of the water chamber, the chamber itself being symmetrically located on the rear plenum wall 14. From the forward end of the tube, the steam passageway includes a downwardly flaring section 48 which terminates in a forwardly extending transversely elongated short leg 50 the forward end of which terminates at the steam discharge port 42. Said port 42 is a slot formed during molding in the rear plenum wall 14. From a manufacturing standpoint, it is desirable to form the leg 50 during the molding operation which creates the plenum chamber 12, and to mold the stub tube 46 and section 48 in one piece in a separate molding operation, the section 48 subsequently being secured to the rear terminus of the leg 50, the securement being effected before the water chamber 28 is secured to the rear plenum wall 14.

The rear plenum wall 14 essentially is flat and uninterrupted, except for the steam discharge port 42 and, optionally, the leg 50 if said leg is molded in one piece with the plenum chamber. The rear wall 30 of the water chamber likewise essentially is flat, the general flatness of both these walls being readily apparent from inspection of FIGS. 1 and 2. The rear wall of the water chamber has a few discontinuities, i.e. deviations from planarity. These includes a rearwardly extending fill-tube 52, a switch-receiving well 54 which projects forwardly from the wall 30 but opens rearwardly, and a forwardly extending and rearwardly and downwardly open electric cord-receiving channel 56. All the foregoing deviations from flatness are shown in FIG. 2.

Rearwardly of the water chamber and mounted on the rear wall 30 thereof is cover 58 which, like the plenum chamber and water chamber, is molded from a synthetic plastic. Desirably, the plastic used for the two chambers and the cover is the same so that they may readily be united. The cover is in the configuration of a shallow tray including a rear cover wall 60, a top cover wall 62, a bottom cover wall 64 and side cover walls 66, 68. Like the two chambers, the cover is rectangular and vertically elongated. The top cover wall 62 is in the same plane as the top wall 32 of the water chamber. The cover is symmetrical with the water chamber in a side-to-side direction. The bottom cover wall is located a short distance above the bottom wall 34 of the water chamber. However, the bottom cover wall includes a downwardly extending portion 70 to cover the rearwardly extending opening of the channel 56 in the water chamber. The downwardly extending portion of this channel receives an electric cord 72 which is held in place where it enters the steamer by an elastomeric grommet 74.

Figure 2:
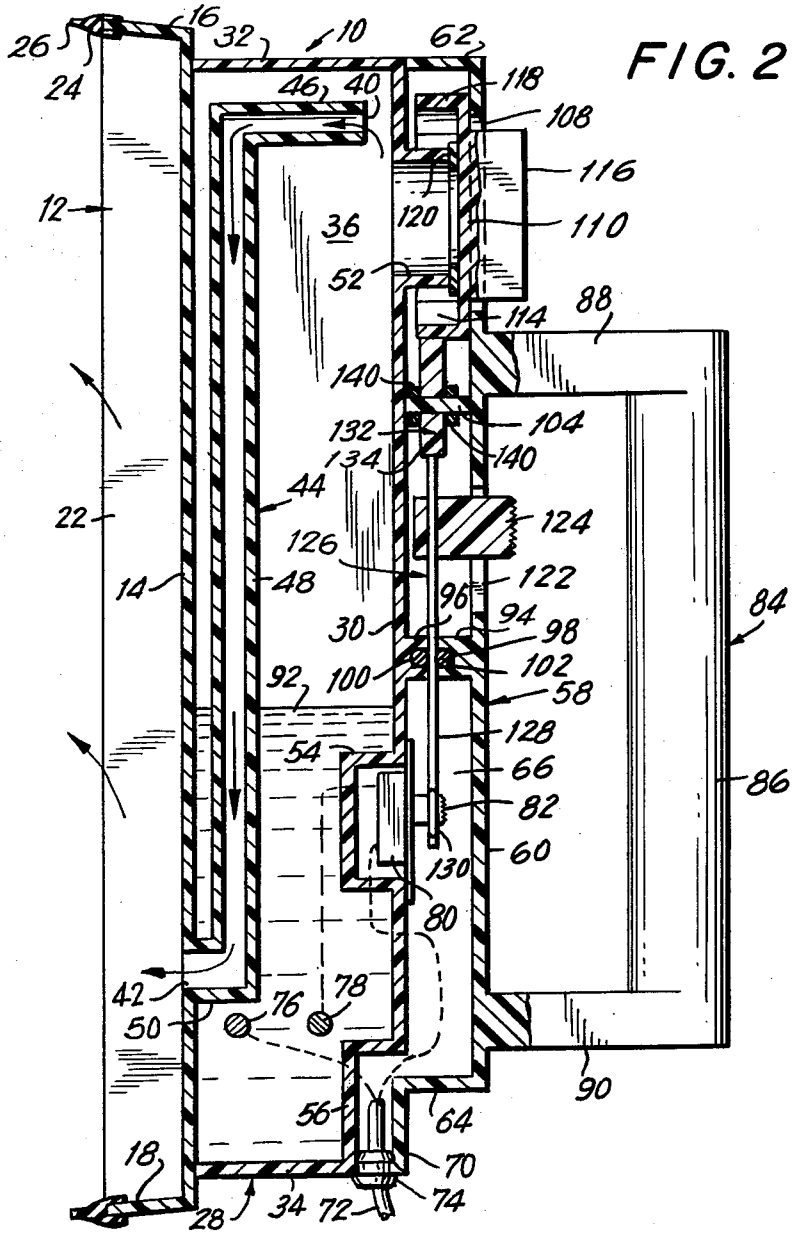
FIG. 2 is a central vertical section substantially taken along the the line 2—2 of FIG. 1.

Wire leads schematically illustrated in FIG. 2 supply energy to one of two electrodes 76, 78 and supply energy through a switch 80 to the other of such electrodes. The switch 80 is received within the well 54 with its rear surface substantially flush with the rear wall 30 of the water chamber. The switch includes a rearwardly extending control element 82. The switch is of a single-pole double-throw type. The switch is not biased to either off or on position and will remain in any position in which it is placed. When the switch control element 82 is in its lowermost position it opens the circuit to the electrode 78. When the switch control element is in its uppermost position it closes the circuit to the electrode 78.

The cover is secured to the rear wall 30 of the water chamber in the same manner that the water chamber is secured to the rear wall of the plenum chamber. In addition to the rear wall and side walls of the cover, the cover includes other protuberances and openings to effect the desired operation of the steamer. Thus, the cover includes a rearwardly extending handle 84 that constitutes a vertical post 86 of rounded configuration for comfortable grasping by a hand. The upper and lower ends of the post are in one piece with forwardly extending pedestals 88, 90 that are connected to the rear surface of the rear wall 60. The handle is so located that it is symmetrically disposed in a side-to-side direction with the cover, the water chamber and the plenum chamber, and is offset somewhat downwardly from the horizontal center line of these parts in order that it will be near the center of gravity of the steamer which is below the center of its mass due to the additional weight of a body of water 92 that in operation is contained within the water chamber.

It should be mentioned at this point that the water is not distilled water or deionized water. The water must contain sufficient ions to act as an electrolyte so that it can carry current between the two electrodes 76, 78. The resistance of the water between said electrodes to the passage of current will create an $I^2R$ heat which raises the temperature of the water eventually to the point of steaming. If this $I^2R$ heat is not sufficiently high in any given usage of the steamer, additional soluble salts are added to the water through the fill-tube to raise the current and lower the resistance and thereby increase the heat generated. For some uses, depending upon the tap water available—tap water being contemplated in the use of the steamer—the cations and anions normally present provide a sufficient conduction for creating a high enough $I^2R$ heat. In other parts of the country the water may be too free from soluble minerals, and salt, for example, table salt, will be added at the discretion of the user.

Attention is directed to the location of the electrodes 76, 78, this constituting a feature of the present invention. The electrodes are so disposed within the water chamber 28 as to satisfy two criteria. The first of these is that at least one of the electrodes be spaced above the bottom wall 34 of the water chamber. The purpose of this spacing is to insure that when the level of the water electrolyte 92 becomes low and the steamer is in its operating position with the steam plenum chamber against a vertical surface, the flow of electric current between the two electrodes which are spaced from each other will be cut off thereby stopping the generation of heat and idling the steamer. This prevents overheating when there is not enough water in the water chamber. Preferably, both of the electrodes, in addition to being spaced from each other, are spaced above the bottom wall of the water chamber.

The second criterion relating to the positioning of the location of the electrodes within the water chamber is that at least one of the electrodes must be so positioned that when the steamer is placed with the open mouth of the steam plenum chamber on a horizontal surface, said one electrode will be above the surface of water in the water chamber. To this end, this one electrode is spaced from the rear wall 14 of the steam plenum chamber and, more specifically, from the rear surface of that wall which is exposed to the interior of the water chamber a distance such that, in the aforesiad horizontal position of the steamer, the volume of the water chamber below such electrode at this time is somewhat less than the volume of the water chamber below the bottom of the fill-tube 52 when the steamer is vertical. Thereby when the steamer is placed on a horizontal surface and siad electrode is above the water in the position it then occupies, the flow of current between the two electrodes will be shut off even if the user forgets to turn off the switch 80, so that there is no danger of burning or damaging anything in the room from which the wallpaper is being removed. Both of the electrodes 76, 78 in the steamer 10 shown in the drawings have the proper spacing from thhe wall 34 to effect the automatic cut-off when the water in the water chamber becomes low, and it is the electrode 78 which is above the surface of the water in the water chamber when the steamer is horizontally disposed.

Each of the electrodes 76, 78 is in the form of a long slender rod a material which will not corrode when exposed to the water. A suitable such material is stainless steel. Preferably, the electrodes are parallel to each other and extend from side to side. However, it will be appreciated that the electrodes may extend in a front-to-back direction and still be so located as to satisfy both the aforesaid criteria. It is emphasized that for these criteria to be satisfied, all of at least one electrode must be located above the surface of the water in the water chamber when the steamer is subjected to either of the mentioned conditions, i.e. low water level or horizontal placement.

It will be observed that the steam entry port likewise must be so located as to be above the level of the water in the water chamber when the steamer is resting on a horizontal surface in order to prevent the egress of water through the steam entry port at such time and the consequent loss of water which is untidy and which, when the water contains considerable salt, may result in spotting of the floor or an object in the room. It has been stated hereinabove that the steam entry port 40 is of small transverse cross-sectional area, this being small with respect to the steam discharge port 42; the purpose for making the steam entry port small is to minimize the possibility of water entering the steam entry port when the steamer is horizontal and also to minimize the amount of water that will flow through this port if, per chance, any water should be introduced therethrough. However, the steam discharge port is large so as to obtain maximum dispersion of steam entering the steam plenum chamber.

Reverting to the cover 58, it further includes in one piece therewith a forwardly extending boss 94 which is in registry with a rearwardly extending boss 96 on the rear wall 30 of the water chamber 28. The tips of the two bosses are in abutment. The surfaces of the bosses that are in fac-to-face contact are provided with matching grooves 98, 100, respectively, designed to receive an O-ring 102 the function of which will be described hereinafter.

The cover also includes a forwardly extending transverse pin 104.

The cover is formed with a large circular opening 108 located directly above the center of the upper pedestal 88. This opening is for accommodation of a fill-cap 110 employed to selectively close or expose the open mouth of the fill-tube 52. The opening 108 has at opposite points on its periphery two radially outwardly extending diametrically opposed notches 112. Correspondingly, the fill-cap has two oppositely radially outwardly extending diametrically opposed lugs 114 which are slightly smaller than the notches 112, so that when the lugs are aligned with the notches the fill-cap can either be advanced through the opening 108 to the fill-tube or withdrawn through the opening 108 from the fill-tube. The fill-cap includes a manipulating handle 116. The fill-cap is made of a synthetic plastic so as to be electrically non-conductive, as are all of the other plastic parts of the steamer. The fill-cap at its periphery has a forwardly extending skirt 118. An elastomeric washer 120 is held to the inner surface of the crown of the fill-cap, being concentrically disposed therein so as to engage the rim of the rear end of the fill-tube 52 when the fill-cap is pressed against the fill tube. It will be observed from inspection of FIG. 2 that when the fill-cap is in its fill-tube-closing position, the rear surfaces of the lugs 114 are forward of the plane of the rear cover wall 60, the rear surfaces of said lugs at this time being in light frictional slidable engagement with the front surface of said rear cover wall, providing, of course, that the lugs have been turned away from the position in which they must be disposed to pass the fill-cap 110 throuugh the opening 108. In other words, at this time the lugs are out of alignment with the notches 112. The movement of the fill-cap toward and away from its fill-tube-closing position will be described in detail subsequently, specifically in connection with the interlock.

Lastly, the rear cover wall 60 includes a vertically elongated opening 122 for accommodating a switch-manipulating button 124 that extends from within the cover to the zone forward of the handle post 86. The vertical elongation of the opening 122 permits vertical movement of said button.

An interlock 126 is provided which includes an actuating rod 128 that may be of metal inasmuch as it is neither near the body of water 92 nor is in contact with any part of the steamer which carries electric current. Nevertheless, in the preferred form of the invention the rod 128 is made of plastic. The rod essentially is a wire-like straight member having at its lower end a U-shaped offset 130. This offset receives the control element 82 for the switch 80. The rod is vertically elongated and is shiftable along its longitudinal axis between a lower position shown in FIG. 3 in which the offset 130 has shifted the control element 82 to switch-off condition, and an upper position shown in FIG. 4 in which the offset 130 has shifted the control element 82 to switch-on condition. The shifting of the actuating rod is performed by use and manipulation of the operating button 124 that extends through the opening 122 immediately below the handle 84. The actuating rod 128 passes through the center of the O-ring 102 which acts to guide vertical movement of the actuating rod and also, by exercising a light frictional grip thereon, to maintain the button 124 and, therefore, the control element 82 and switch 80 in any position to which they last have been moved.

Figure 4:
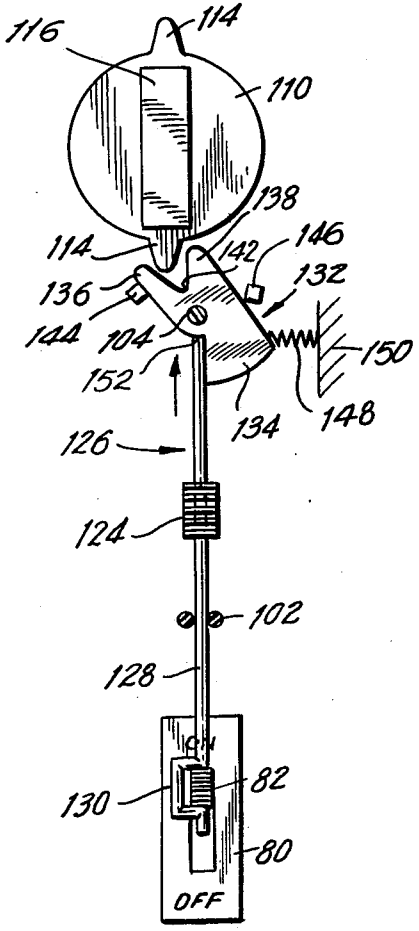
FIG. 4 is a view similar to FIG. 3 but illustrating the fill-cap in its closed and locked position, the switch operator in switch-on position, and the switch interlock in a position blocking rotation of the fill-cap away from locked position.
Figure 3:
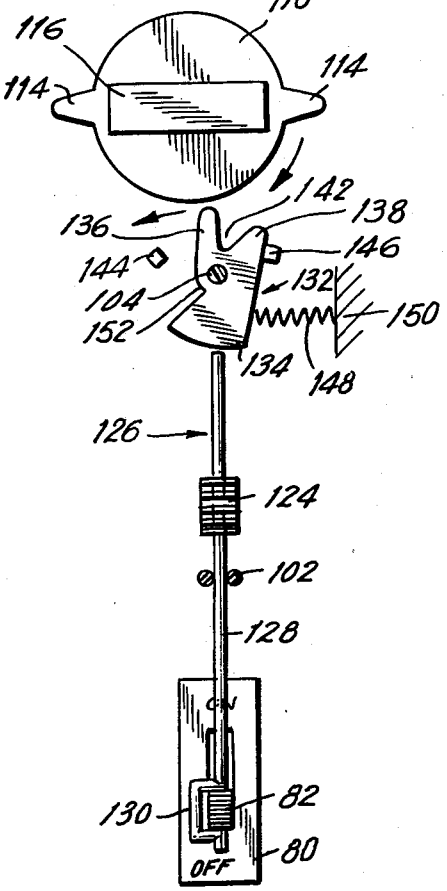
FIG. 3 is a skeleton rear view of all parts (except the parts not involved) that constitutes the switch, the fill-cap, the switch interlock and the switch operator, the same being shown with the switch and switch operator in switch-off position, the fill-cap in open position preparatory to removal thereof, and the switch interlock in a switch-operator-blocking position.

The interlock 126 further includes a sear 132 which preferably is made from plastic and is pivoted on the pin 104. The sear is a flat piece of plastic which essentially is coplanar (in a vertical plane parallel to the walls 30 and 60 between which it lies along with the rod 128) and is Y-shaped, being provided with a lower broad leg 134 and a pair of fingers, to wit, a left finger 136 and a right finger 138 (viewed from the back of the steamer as in FIGS. 3 and 4). The sear is rotatable on the pin 104 and is held against axial movement relative to the pin as by friction washers 140 so that its plane remains in the plane of the actuating rod 128. The fingers 136, 138 define a V-shaped notch 142. The sear is rotatable between two angular positions, to wit, a left counterclockwise position as shown in FIG. 4 and a right clockwise position as shown in FIG. 3. The sear is restricted to this limited angle of rotation by a left detent 144 and a right detent 146. A helical coil compression spring 148 has its length disposed between a side (the right-hand side as viewed in FIGS. 3 and 4) of the sear leg 134 and a stationary abutment 150. The left and right detents 144, 146 and the abutment 150 can be molded in one piece with either the rear wall 30 of the water chamber or the rear cover wall 60. The bottom of the sear leg 134 is rounded with its radius of curvature approximately at the center of the pin 104. The left-hand side (as viewed from the rear of the steamer—see FIGS. 3 and 4) is provided with a shoulder 152 that, when the actuating rod 128 is in its switch-on position, is in line with said rod. Said shoulder 152 is rounded with its radius of curvature substantially at the pin 104. The tips of the fingers 136, 138 lie in the path of travel of the lugs 114 when the fill-cap 110 is located in the opening 108 concentrically with the fill-tube 52 and is turned. The notch 142 is sufficiently large to easily accommodate either lug 114.

The coaction between the fill-cap 110 and the interlock 126 effected by the aforesaid construction is such that the switch cannot be shifted from off to on position unless the fill-cap has been inserted in the opening 108 and turned to a fully-closed position, and the fill-cap cannot be turned from its closed position (see FIG. 4) to its open position (see FIG. 3) while the switch is in on condition. Such coaction prevents the possitility that anyone can insert an electrically-conductive element through the fill-cap into the body of water when the fill-cap is off and the switch is in on condition, whereby the danger of a user or child receiving an electric shock is avoided. This arrangment negates the chance of an accidental application of electricity to a person if the switch 80 were momentary and the biasing means therein failed with the switch in closed position. It will be recalled that the switch 80 in the present invention is not a momentary switch but, rather, will remain in the last condition, be it off or on, to which it was moved manually.

The fill-cap and interlock operate as follows:

Let it be assumed that the actuating rod 128 is in its off position as shown in FIG. 3 and that the fill-cap is off, that is to say, removed from the stemaer. This is similar to the arrangement of parts illustrated in FIG. 3 except that the fill-cap is not even near the steamer. At this time the spring 148 bearing against the right-hand side of the sear leg 134 has shifted the sear to its extreme clockwise position in which the right-hand side of the right-hand finger 138 bears against the right detent 146. At this time the position of the bottom of the sear leg 134 is directly above the tip of the actuating rod 128, said rod then being in its lowermost position in which it has last shifted the control element 82 to switch-off condition Should a user then attempt to shift the actuating rod to a switch-on position, as a child or careless adult might, such movement will be prevented by the blocking action exerted by the sear 126. Now, let it be assumed that the fill-cap is mounted on the steamer. This is down by inserting the skirt 118 of the fill-cap through the opening 108 so as to straddle, i.e. embrace, the fill-tube 52. To insert the fill-cap in this position it first is necessary to align the lugs 114 with the notches 112. The fill-cap will not yet retain itself in closing position. To do this, the fill-cap must be rotated, e.g. clockwise as viewed in FIG. 3, from its inserting position shown in this figure to its fully-closed position shown in FIG. 4. In the latter position the lugs which were in horizontal alignment when inserted (see FIG. 3) now are in vertical alignment (see FIG. 4) as the fill-cap is rotated clockwise 90° from its insertion position to its closed position. (In its closed position the rear surfaces of the lugs 114 bear lightly frictionally against the forward surface of the rear cover wall 60 and the crown of the fill-cap lightly compresses the resilient washer 120 between it and the rearwardly facing edges of the mouth of the fill-tube so as to seal the water chamber.) As the fill-cap turns from its inserted to its fully-closed position, one of the lugs 114 (the right-hand lug as viewed in FIG. 3) during its movement strikes the right-hand edge of the left finger 136 and turns the sear 126 from its actuating-rod-blocking position illustrated in FIG. 3 to the sear position shown in FIG. 4. The sear experiences a counterclockwise rotation at this time from the one in which the right-hand edge of the right-hand finger abutted the right detent 146 to the FIG. 4 position in which the left-hand edge of the left-hand finger 135 abuts the left detent 144. It will be observed that during the shifting movement of the sear caused by angular movement of the lug which engages the sear, the lug is located within the V-shaped notch 142. With the sear in its FIG. 4 position caused by movement of the fill-cap to its fully-closed position, the lower edge of the sear leg 134 has rocked from its actuating-rod-blocking position of FIG. 3 out of such blocking position as shown in FIG. 4. Hence, the user may now, if he so desires, shift the actuating rod 128 from its switch-open position to a switch-closed position as shown in FIG. 4. In other words, inserting and turning the fill-cap has freed the switch-operating button 124 and, therefore, the actuating rod 128 for movement between (in either direction) switch-open and switch-closed position, so that as long as the fill-cap is on and in its closed position the user can, at will, turn the steamer off or on and is unable to insert his finger or a metallic object into the fill-tube and possibly be subjected to an electric shock.

However, while the button 124 thus is free to move between open and closed position, the limits of the movement of the button being defined by opposite ends of the elongated opening 122, the fill-cap cannot be removed while the button and the actuating rod are in switch-on position. The reason that this restraint is effective can be appreciated by observation of FIG. 4. When the button 124 and actuating rod 128 are in switch-on position as shown in FIG. 4, the upper portion of the actuating rod is in the path of counterclockwise movement of the left-hand side of the sear leg 134. Incidentally, the upper tip of the actuating rod is, at such time, in contact with or adjacent the shoulder 152 which may, if desired, serve to limit upward movement of the actuating rod 128, although this purpose may be served equally well either by abutment of the control element 82 with the upper end of the vertically elongated slot in the face plate of the switch 80, or abutment of the upper edge of the button 124 with the upper end of the opening 122. To remove the fill-cap one cannot simply retract the same rearwardly. Such movement is prevented by the rear wall 60 of the cover. To remove the fill-cap one first must rotate it until the lugs 114 are in alignment with the notches 112. This rotation cannot be accomplished while the actuating rod is in switch-on position. It is not possible at this time to turn the fill-cap in a clockwise direction for alignment purposes because the sear cannot be rocked further in a clockwise direction due to abutment between the left-hand side of the left finger 136 with the left detent 144, and the fill-cap cannot be moved in a counterclockwise direction because the upper portion of the raised actuating rod is in the clockwise path of movement of the left-hand side of the sear leg 134. In other words, at this time the sear is not rockable, except to a slight extent, so that the fill-cap, in effect, is angularly locked in its closed position to achieve the desired prevention of removal of the fill-cap so long as the switch is in closed condition. To free the sear and the fill-cap, it simply is necessary to move the actuating rod to switch-off position, at which time the sear no longer is restrained against angular movement and, hence, the fill-cap may be turned in a counterclockwise direction back to an angular position in which its lugs and the notches 112 are aligned to permit withdrawal of the fill-cap.

To operate the steamer one turns the switch button to switch-off position, removes the fill-cap whose movement at this time is not inhibited, pours water, optionally with some table salt dissovled therein, through the fill-cap into the water chamber, replaces the fill-cap and turns it to closed position, and shifts the button 124 to switch-on position. Before such movement of the button, the electric cord is plugged into a source of power. The steamer now is ready for operation.

As long as the body of water bridges the electrodes 76, 78, heat will be electrolytically generated and the steam rising from the body will flow into the steam entry port and out of the steam discharge port. If the steamer is in actual physical use for removal of wallpaper from a vertical surface, the plenum chamber will be disposed with its open mouth facing the wallpaper and the steam issuing from the discharge port will fill the plenum chamber and penetrate the wallpaper to loosen the adhesive bond between it and the substrate. The user moves the steamer about on the wall, constantly holding the steamer against the wall in vertical position. If the position should deviate somewhat from vertical, even to the extent that the steamer is horizontal, electrolytic heating will continue and discharge of steam will continue as long as there is enough water in the water chamber to bridge the electrodes. As soon as the level of water falls below a bridging position between the electrodes, the steamer automatically becomes ineffective despite the fact that the switch is in on position, and the user will immediately become aware of the fact that steam no longer is issuing from the steamer. Presumably, he will have the intelligence to stop the steaming operation. He cannot remove the fill-cap to insert fresh water into the water chamber until he has turned the switch off, so that the danger of electric shock is prevented. Again, presumably, he will have sufficient intelligence to turn the steamer off, remove the fill-cap, insert a fresh charge of water, replace and close the fill-cap, and turn the switch on again to resume steaming operations.

If, for any reason, the user, either because he is tired or hungry or distracted or called to some other duty, places the steamer, with the switch still on and with water still in the chamber, on a horizontal surface, there is no danger of any untoward occurrence. This is because the water in the water chamber now has moved to a low horizontal position in which its upper surface is below at least one of the electrodes 78; hence, heating immediately ceases. Moreover, when the user places the steamer in such horizontal position, the level of water in the water chamber is below the steam entry port 40, so that no water accidentally can flow through the steam passageway and the steam discharge port onto the surface on which the steamer is resting.

It further will be observed that during use of the steamer the steam entry port is well above the level of water in the water chamber. Indeed, it is above the level of the fill-tube, so that there is very little chance of water accidentally entering the steam passageway and being allowed to find its way to the plenum chamber where it could drip onto the wall surface. This possibility further is lessened by the small size of the steam entry port relative to the steam discharge port.

It has been pointed out previously that all of the larger components and, indeed, most of the smaller components, of the stemaer are made of plastic. This prevents the possibility of electric shock and has the further advantage that the steamer, as a whole, is very light. When to this is added the compactness of the parts by virtue of the relative arrangement therebetween (plenum chamber in front, water chamber in back of the plenum chamber, cover, handle and operating mechanisms in back of the water chamber), it will be seen that the steamer is quite light and very easy to manipulate for its intended use.

If desired, the switch 80 and interlock 126 may be ommitted inasmuch as the device will turn itself off when not effective for use, as when the water level is too low or the device is placed with the mouth of the plenum chamber on a horizontal surface.

It thus will be seen that there is provided a device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention there is claimed as new and desired to be secured by Letters Patent:

1. A portable hand manipulatable steamer for applying steam to a vertical surface, said steamer comprising:

A. a steam plenum chamber having
  I. front, side and rear walls, a top and a bottom,
  II. means providing an open steam discharge mouth in a wall of the plenum chamber and being disposed in a vertical plane when the steamer is used,
B. a water chamber mounted on the plenum chamber and
  I. having front, side and rear walls, a top and a bottom,
  II. a wall other than the rear wall of the water chamber and a wall other than the front wall of the steam plenum chamber being a common wall to both said chambers,
  III. said water chamber having means providing a fill-opening therein,
C. a cap for selectively closing said fill-opening,
D. means associated with said common wall providing a steam passageway entirely disposed on the water chamber side of said common wall,
  I. said steam passageway having a steam entry port within the water chamber and
  II. having a steam discharge port in the common wall facing the steam plenum chamber and located immediately adjacent the bottom of the steam plenum chamber,
  III. said common wall being flat and uninterrupted except by said steam discharge port,
  IV. said steam entry port being immediately adjacent the top of said common wall,
E. a pair of spaced electrodes in and near the bottom of the water chamber,
F. means for supplying electric power to said electrodes,
  I. whereby when said electrodes are energized they will generate heat electrolytically by passage of electric current therebetween and through water in the water chamber, G. switch means interposed between the electrodes and the means for supplying electric power to control energization of the electrodes from the means for supplying electric power, and H. said steamer further including a handle for moving the steamer out on a wallpapered vertical surface.

2. A steamer as set forth in claim 1 wherein the plenum chamber, the water chamber, the steam passageway and the handle are of a synthetic electrically nonconductive plastic.

3. A steamer as set forth in claim 1 wherein the water chamber has a bottom wall and wherein at least one of the electrodes is above the bottom wall so that when the level of water in the water chamber drops below said electrode no heat will be electrolytically generated even when the switch means energizes the electrodes.

4. A steamer as set forth in claim 1 wherein the location of the electrodes in the water chamber is such that when the mouth of the steamer is horizontal and facing downwardly and the level of water in the water chamber is low, one of the electrodes is above the level of wter in the water chamber so that in such position of the steamer no heat will be electorlytically generated even when the switch means energizes the electrodes.

5. A steamer as set forth in claim 1 wherein the cross-sectional area of the steam discharge port is considerably larger than the cross-sectional area of the steam entry port.

6. A steamer as set forth in claim 5 wherein the steam discharge port is elongated transversely of the steamer.

7. A steamer as set forth in claim 1 wherein the electrodes are parallel to each other, are spaced apart, are located near the bottom of the water chamber, lie in a common horizontal plane when the steamer is in use, and extend in a direction from side to side of the steamer with one electrode being closer to the steam plenum chamber than the other electrode.

8. The portable hand-manipulatable steamer in accordance with claim 1 wherein said steam passageway includes a downwardly flaring section extending from said steam entry port to said steam discharge port, said steam discharge port being elongated transversely of said plenum chamber.

9. A portable hand-manipulatable steamer for applying steam to a vertical surface, said steamer comprising:

A. a steam plenum chamber having
  I. front, side and rear walls, a top and a bottom,
  II. means providing an open steam discharge mouth in a wall of the plenum chamber and being disposed in a vertical plane when the steamer is used,
  III. a cover mounted on the rear wall of the plenum chamber, B. a water chamber mounted on the plenum chamber and
  I. having front, side and rear walls, a top and a bottom,
  II. a wall other than the rear wall of the water chamber and a wall other than the front wall of the steam plenum chamber being a common wall to both said chambers,
  III. said water chamber having means providing a fill-opening therein,
  IV. a fill-tube extending from the water chamber and terminating in the fill-opening,
    i. said cover having an opening registering with the fill-opening,
    ii. said fill-opening being spaced forwardly from the forward face of the cover, C. a fill-cap for selectively closing said fill-opening,
  I. the fill-cap, when in closed position, having a crown located within the cover with the rear surface of the crown butted against the forward surface of the cover and the front surface of the crown butted against the fill-opening, said fill-cap including a portion extending through the cover opening for manipulation of the fill-cap, D. means associated with said common wall providing a steam passageway entirely disposed internally of the steamer,
  I. said steam passageway having a steam entry port within the water chamber and
  II. having a steam discharge port in the common wall facing the steam plenum chamber,
  III. said steam entry port being near the top of said common wall, E. a pair of spaced electrodes in and near the bottom of the water chamber, F. means for supplying electric power to said electrodes,
  I. whereby when said electrodes are energized they will generate heat electrolytically by passage of electric current therebetween and through water in the water chamber, G. switch means interposed between the electrodes and the means for supplying electric power to control energization of the electrodes from the means for supplying electric power, and H. said steamer futher including a handle for moving the steamer about on a wallpapered vertical surface,
  I. the handle and the switch means being carried by the cover.

10. A portable hand-manipulatable steamer for applying steam to a vertical surface, said steamer comprising:

A. a plenum chamber having
  I. open mouth lying in a vertical plane when the steamer is used,
  II. said plenum chamber including a rear wall, B. a water chamber mounted on the rear wall of the plenum chamber and
  I. having a rear wall,
  II. said water chamber having a fill-opening therein, C. a cap for selectively closing said fill-opening, D. a steam passageway
  I. having a steam entry port within the water chamber and
  II. a steam discharge port in the rear wall of the plenum chamber,
  III. said stem entry port being near the top of the water chamber and near said rear wall thereof, E. a pair of spaced electrodes in and near the bottom of the water chamber, F. means for supplying electric power to said electrodes
  I. whereby when said electrodes are energized they will generate heat elecrolytically by passage of electric current therebetween and through water in the water chamber, G. said steam further including a handle carried thereby for moving the steamer about on a wallpapered vertical surface, H. a manually operable on-off switch interposed between the electrodes and the means for supplying electric power, J. a manually actuable operator on the exterior of the steamer and connected to the switch for operation thereof, and K. interlock means between the operator and the fill-cap for preventing opening of the fill-cap when the switch means is actuated to the on position by said operator and for preventing said operator from being manually manipulated to actuate the switch to the on position unless the fill-cap is in closed position.

11. A portable hand manipulatable steamer for applying steam to a vertical surface, said steamer comprising:

A. a plenum chamber having

I. an open mouth lying in a vertical plane when the steamer is used,

B. a water chamber,

C. a steam passageway between the two chambers,

D. a pair of spaced electrodes in the water chamber,

E. means for supplying electric power to said electodes

I. whereby when said electrodes are energized they will generate heat electrolytically by passage of electric current therebetween and through water in the water chamber, F. manually operable switch means having an off position and an on position, said switch means being carried by the steamer for controlling energization of the electrodes, I. said switch means including manually manipulatable means for actuating said switch, II. said manually manipulatable means being manually operable from both the off and on positions of the switch to the other switch position, III. said switch means maintaining itself in either position to which it has been moved, G. a fill-opening in the water chamber, H. a movable fill-cap for selectively opening and closing the fill-opening, and J. interlock means between the manually manipulatable means and the fill-cap for preventing opening of the fill-cap when the switch means is actuated to said on position and for preventing the manually manipulatable means from being manually manipulated to actuate said switch to said on position unless the fill-cap is in closed position.

12. A steamer as set forth in claim 11 in which the steamer has a cover with an opening therein overlying the fill-opening, the opening in the cover being of non-circular configuration, the removable rotatable fill-cap having a non-circular configuration to match the configuration of the opening in the cover so that the fill-cap can be inserted through the opening in the cover only when the configurations of the cover opening and fill-cap are rotated into angular alignment, said fill-cap being insertable through said opening in the cover to engage the fill-opening when the configurations of the fill-cap and cover opening are in angular alignment and the fill-cap being locked inside the cover when it is turned to a position wherein its configuration is non-aligned with respect to the configuration of the cover opening after being inserted through the opening in the cover, the fill-cap including a portion adapted to extend outwardly through the cover opening for manipulation and removal of the fill-cap.

13. A steamer as set forth in claim 12 wherein the interlock means includes a member provided between the manually manipulatable means and the fill-cap and which member prevent movement of the fill-cap when the fill-cap is in closed position and the manually manipulatable means is in switch-on position, and prevents movement of the manually manipulatable means from switch-off to switch-on position when the fill-cap is not in its closed position.

14. A steamer as set forth in claim 13 wherein said member is a Y-shaped sear having a leg and two branched fingers, and spring means to urge the leg into a postion blocking movement of the manually manipulatable means away from switch-off position when said fill-cap is in its open position, said sear being rotated away from said blocking position by rotation thereof by the fill-cap when the fill-cap is moved to its closed position, said movement of the seair being caused by engagement of the fill-cap with the walls defining the space between the fingers, and the manually manipulatable means blocking movment of the sear and therefore of the fill-cap when the manually manipulatable means is in switch-on position and the fill-cap is in its closed position.

* * * * *